United States Patent [19]

Jackson

[11] 4,280,487

[45] Jul. 28, 1981

[54] PULSATING INFLATABLE-DEFLATABLE PAD ASSEMBLY AND METHOD

[75] Inventor: Barry N. Jackson, De Pere, Wis.

[73] Assignee: American Hospital Supply Corporation, Evanston, Ill.

[21] Appl. No.: 54,837

[22] Filed: Jul. 5, 1979

[51] Int. Cl.[3] ..... A61H 1/00

[52] U.S. Cl. ..... 128/33; 128/64

[58] Field of Search ..... 128/64, 24 R, 33, 38–40

[56] References Cited

U.S. PATENT DOCUMENTS

| | | | |
|---|---|---|---|
| 2,998,817 | 9/1961 | Armstrong | 128/33 |
| 3,462,778 | 8/1969 | Whitney | 128/33 X |
| 3,467,081 | 9/1969 | Glass | 128/33 |
| 3,653,083 | 4/1972 | Lapidus | 128/33 X |

*Primary Examiner*—John D. Yasko

*Attorney, Agent, or Firm*—Tilton, Fallon, Lungmus

[57] ABSTRACT

An apparatus and method are disclosed for promoting the evaporation of perspiration from an absorbent sheet of foam or other material covering an inflatable-deflatable patient-supporting bed pad. The pad has a multiplicity of perforations in its top wall which communicate with a pair of interlaced passages or chambers within the pad. By pulsing the air supplied alternately to each chamber of the pad at a frequency within the range of about 15 to 65 pulses per second, the perforations provide a multiplicity of tiny puffing or pulsing jets of air into the foam sheet to promote the evaporation of moisture from that sheet. Means for overlapping the inflation-deflation cycles is also disclosed.

23 Claims, 3 Drawing Figures

PULSATING INFLATABLE-DEFLATABLE PAD ASSEMBLY AND METHOD

BACKGROUND AND SUMMARY

U.S. Pat. No. 3,653,089 discloses an aerated bed pad having interlaced chambers which are alternately inflated from a pressure source and which are cyclically deflated by reason of the escape of air through perforations in the top surface of the pad. The escaping air passes into a foam sheet which overlies the pad, such sheet not only diffusing the escaping air but also serving as a means for absorbing perspiration and drawing it away from the patient, thus preventing or greatly reducing maceration of tissue. The air discharged from the pad into the foam sheet assists in the evaporation of moisture from that sheet. A system embodying such features, intended primarily for reducing the development of decubitus ulcers in bedridden patients, has been commercially available for a number of years through applicant's assignee, such system being marketed as the Lapidus Air Float system.

The commercial Air Float system has utilized a rotary compressor for delivering a smooth non-pulsating stream of pressurized air alternately to each of the inflatable chambers of the pad. While pulsatile pumps or compressors of the piston or diaphragm type are well known for a variety of other applications, their use with inflatable pads has not been considered advantageous, at least to the extent that pulse-dampening chambers are thought to be necessary for the purpose of smoothing out the pulses developed by such pumps. See, for example, U.S. Pat. No. 3,462,778 which discloses a need for a pulse dampener interposed between a pulsatile pump and an inflatable-deflatable pressure pad. Other patents of general interest are U.S. Pat. No. 3,148,391, 3,672,354, 3,866,606, 3,297,023 and 3,008,465.

One aspect of this invention lies in the discovery that a pulsatile air pump or compressor is not undesirable but is in fact highly advantageous in an alternating pressure pad system if that system is of the particular type disclosed in U.S. Pat. No. 3,653,083; that is, a system in which air is discharged upwardly from perforations in the top of the pad and into a resilient sheet of foam or other porous moisture-absorbent air-permeable material. Specifically, it has been found that the pulsatile discharge of air through the tiny openings of the pad tends to promote the rapid evaporation of moisture absorbed by the cover sheet. Since the sheet is interposed between the patient and the pad, and since the sheet serves as a dampener as well as a diffuser, no streams of pulsating air impinge directly on the patient. Any pulsations or changes in pad pressure tend to be sensed as pleasant vibrations having a mild stimulating or circulation-promoting effect.

In brief, the system includes a pad having two sets of interlaced inflatable-deflatable air chambers or passages and having a multiplicity of perforations through its top surface to permit the controlled escape of air from those chambers where they are inflated. A porous air-permeable liquid-absorbing sheet covers the top surface of the pad and serves to absorb perspiration from a patient as well as to diffuse air discharged through the pad's perforated top surface. As already indicated, a distinctive feature of the combination lies in the fact that the inflating means for cyclically and alternately inflating each of the chambers of the pad while the other of such chambers is deflating takes the form of a pulsatile pump or compressor which is capable of pulsing the air supplied to the pad at a frequency within the general range of 15 to 65 pulses per second, the preferred range being about 25 to 35 pulses per second. Because of the rapidly pulsing discharge of air through the perforations of the pad and into the fluid-absorbing cover sheet, liquid held by the cover sheet tends to be dispersed and the evaporation of such liquid is thereby promoted.

The assembly also includes a control valve for redirecting the air from the pulsatile pump along an alternate route containing a flow restrictor which dampens out the pulses in the pressurized air flowing to the pad. Therefore, through selective operation of the control valve, a user may or may not avail himself of the benefits of pulsating discharge of air into the porous moisture-absorbent cover sheet.

Slight undulations occur, alternating pressure points and stimulating peripheral circulation, as the chambers of the pad are alternately and cyclically inflated and deflated. Solenoid-operated valves and solid-state electronics are used to control the flow of air to the respective chambers and, because of the sharp cut-off and onset of air flow which such valves produce, the system of the present invention is ideally programmed so that the inflation of each chamber commences just slightly before the flow of air to the other chamber is discontinued. The extent of overlap falls within the general range of about 0.3 to 3.0 seconds and insures that no objectionable rise-fall effects, and no momentary bottoming out effect, will occur during pad operation.

Other features, advantages, and objects of the invention will become apparent from the drawings and specification.

DRAWINGS

DETAILED DESCRIPTION

Figure 1:
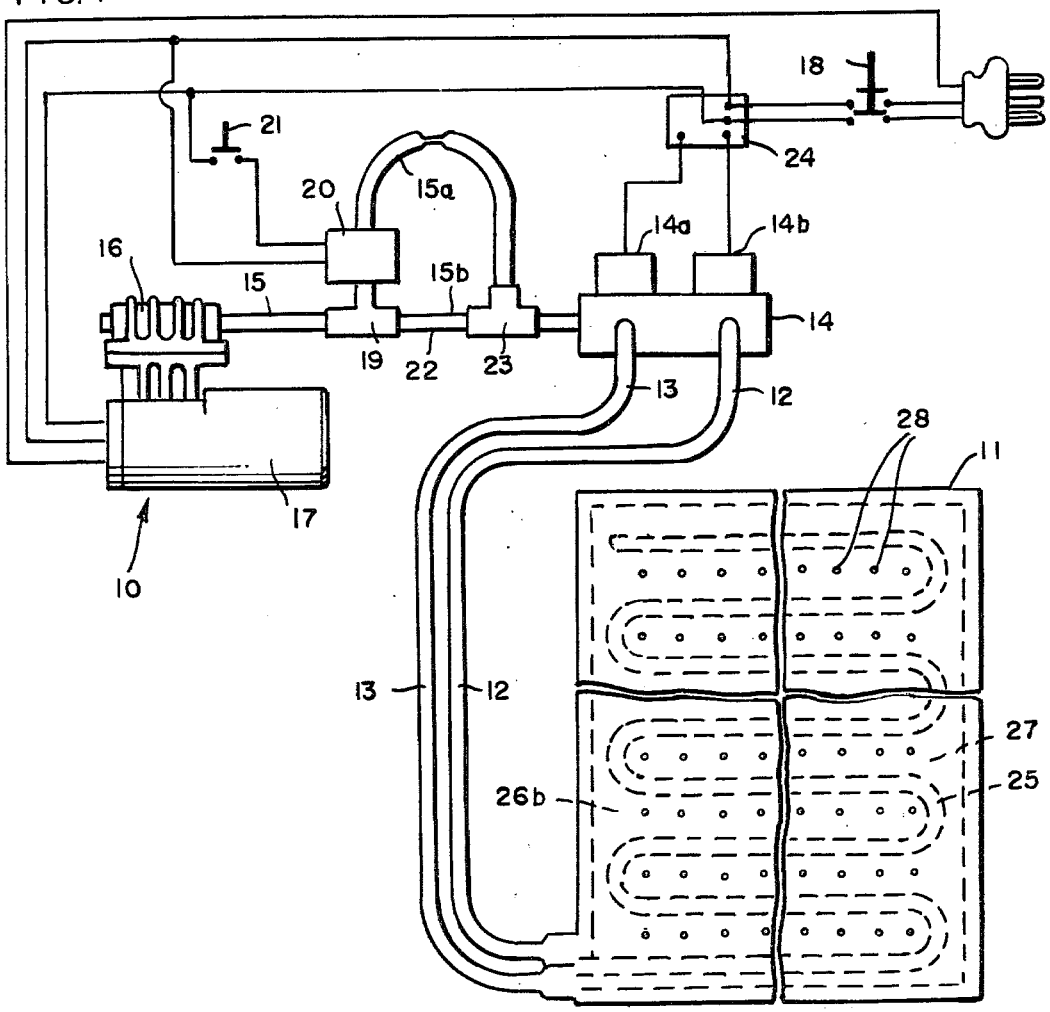
FIG. 1 is a diagrammatic view of an inflatable-deflatable pad system embodying the invention.

Referring to FIG. 1, the numeral 10 generally designates a system or assembly comprising an inflatable pad 11, tubes 12 and 13 leading to that pad from selector valve 14, a conduit 15, branched to provide alternative passages 15*a* and 15*b* leading to the selector valve, and an air pump or compressor 16 communicating with conduit 15. A conventional electric motor 17 drives the compressor, the motor operating off of standard line current and being controlled by on-off switch 18. The motor-compressor may be of a type commercially available as an integrated unit, the primary requirements being that such an assembly have sufficient capacity and durability for use as the source of pressurized air for the system and that it be capable of developing pulses of air having a frequency within the general range of 15 to 65, and preferably 25 to 35, pulses per second. An optimum frequency is believed to be about 29 to 30 pulses per second. One example of a commercially available motor-operated piston compressor suitable for use in practicing the invention is a Wobble compressor marketed by Thomas Industries, Sheboygan, Wis., but other brands and types of pulsatile compressors (piston (linear or rotary), diaphragm, or bellows) might be used.

The flow line 15 from the compressor leads to a tee connector 19, one leg of which is connected to passage 15*a* and another to passage 15*b*. A solenoid valve 20 is located in passage 15*a* and is controlled by a switch 21 for opening and closing that passage. Passage 15*a* includes a pulse dampener in the form of a flow restrictor 22, schematically illustrated in FIG. 1, which has a reduced orifice capable of eliminating pulsations from the flow downstream from that orifice. When switch 21 is closed, the valve 20 is opened so that air from the compressor must flow through passage 15*a* and 15*b* and flow restrictor 22. On the other hand, when the valve 20 is closed, air follows passage 15*b*, thereby bypassing the orifice. Such air flowing through passage 15*b* thereby carries or transfers the pulses developed by operation of pulsatile pump or compressor 16. Whether the air travels only through passage 15*b*, or through both 15*a* and 15*b*, it ultimately flows through tee connector 23 and into selector valve assembly 14.

In the embodiment illustrated, air flows through both passages 15*a* and 15*b* when the system is in its non-pulsing mode; however, it is to be understood that similar but somewhat less effective results may be achieved by routing the air only through the restricted passage 15*a* when the system is in its non-pulsing mode. Pulses will be eliminated by the restrictor but flow rates may be substantially less than in the preferred version shown.

The selector valve assembly 14 includes solenoid valves 14*a* and 14*b* in circuit with an electrical timer 24. The timer automatically controls the operation of solenoid valves 14*a* and 14*b* which in turn direct the pressurized air from the compressor into tubes 12 and 13 leading to pad 11.

The pad may be formed as disclosed in co-owned U.S. Pat. No. 3,653,083. In a typical construction, pad 11 is formed of upper and lower thermoplastic panels or sheets 11*a* and 11*b* heat sealed together along transversely-extending lines 25 as well as along their borders to define two interlaced or interdigitating chambers 26 and 27 fed by tubes 12 and 13, respectively. The top panel 11*a* of the flexible pad is provided with a multiplicity of small perforations 28 which communicate with the two chambers to allow the escape of air from those chambers.

Figure 2:
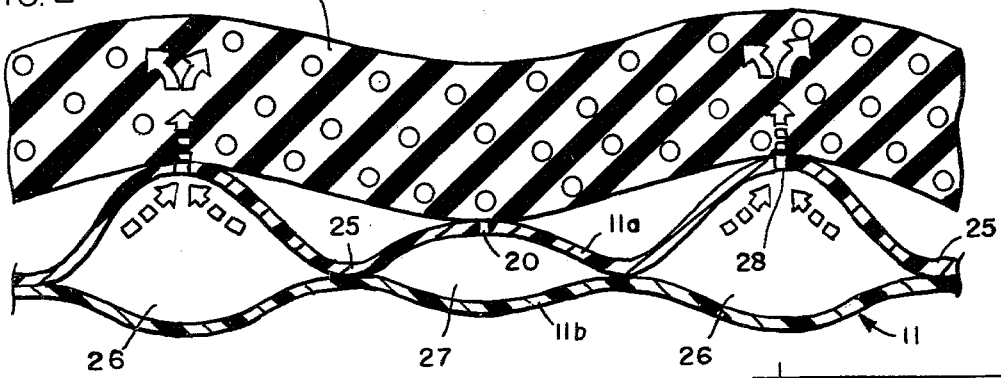
FIG. 2 is an enlarged schematic vertical sectional view illustrating the relationship of the inflatable pad and the absorbent cover sheet during operation of the system.

A porous, resilient, moisture-absorbent, and air-permeable sheet 30 covers the pad as indicated in FIG. 2. The sheet is advantageously formed of an open-celled resilient plastic foam, such as a polyurethane foam, although other moisture-absorbent, air-permeable sheet materials might be used.

When the solenoid valve 20 is closed and the motor-operated pulsatile pump 16 is operating, pulsating air from the compressor flows through selector valve 14 into one chamber or the other of inflatable pad 11 to cause inflation of that chamber. For example, in FIG. 2, transversely extending portions of chamber 26 are shown in inflated condition, while portions of chamber 27 are undergoing deflation. After an interval of approximately 10 to 30 seconds (intervals of about 14 to 16 seconds have been found particularly effective) timer 24 and selector valve 14 automatically discontinue the flow of air to chamber 26 and commence the flow of pressurized air to chamber 27, thereby reversing the condition depicted in FIG. 2.

Figure 3:
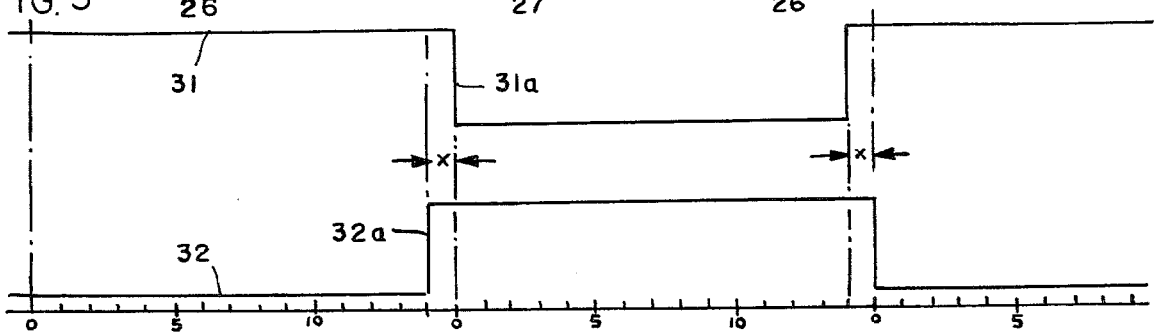
FIG. 3 is a diagram illustrating the relationship of the inflation-deflation cycles of the respective chambers of the pad.

In a preferred embodiment of the invention there is a slight overlap of the inflation cycles of the respective chambers so that one chamber begins to receive inflating air before the flow of such air to the other chamber is interrupted. Such a relationship is graphically depicted in FIG. 3 where line 31 represents the inflation-deflation cycle of chamber 26 and line 32 represents the deflation-inflation cycle of chamber 27. More precisely, lines 31 and 32 indicate the operations of valves 14*b* and 14*a*, respectively, with the elevated portions of each line indicating an open valve condition and the lowered portion representing a closed condition. A 16 second interval is shown for inflation and a 14 second interval for deflation with an overlap of one second, represented by the letter "x," between the cycles of the respective chambers. Thus, valve 14*a* opens to allow air under pressure to enter chamber 27, as indicated by vertical line portion 32*a*, one second before valve 14*b* closes to cut off the flow of compressed air to chamber 26, as represented by vertical line portion 31*a*. By reason of such overlap, excessive fluctuations in the total thickness of the pad, and any momentary bottoming out that might otherwise occur if one chamber were deflated before the other became fully inflated, may be avoided. Also, by timing the duration of the cycles so that a chamber begins to inflate before sufficient time has elapsed for it to become completely deflated by the escape of air through perforations 28, the sudden inflow of pressurized air into that chamber is less likely to produce any popping sounds or cause any objectionable pressure surges.

The duration of the overlap of the cycles may be varied considerably but, in general, should fall within the range of about 0.3 to 3.0 seconds. If desired, the electronic circuit of timer 24 may include a variable resistor to permit a user to vary the duration of overlap of the cycles. The particular duration of overlap selected, whether adjustable or not, depends in part on the extent to which any rise-fall effects in supporting the patient are to be eliminated, and upon the size of the pad, the number and size of the perforations, the capacity of the compressor, etc. In general, the minimum pressure in a chamber—that is, the pressure in a chamber at the end of the inflation phase just before pressurized air is supplied to the other chamber—should be no less than 1.0 psi and, preferably (especially for adult use of the pad), no less than 1.5 psi. Flow rates through the pad 11 would vary depending on the size of the pad and the number and size of the perforations. Acceptable flow rates within the range of about 80 to 110 cubic feet per hour have been obtained by simply adjusting the number of perforations until the desired rate is obtained or the same effect can be obtained with a fixed number of perforations using an adjustable pressure relief valve or flow restrictor.

As indicated, the frequency of the pulsations should fall within the general range of about 15 to 65 pulses per second. With each pressure pulse into an inflated chamber, such as chamber 26 in FIG. 2, puffs of air escape through perforations 28. The velocity of air escaping through the perforations varies during each puff, with the result that the pulsing jets of air penetrate well into the porous sheet 30 and the efficiency of evaporation of liquid held within the cells or pores of that sheet is enhanced. In addition, the pulsing of the pressurized air results in a definite and noticeable pressure oscillation which can be felt by a user even though the porous cover sheet 30 thoroughly diffuses the air discharged from the pad 11. Such vibratory action is normally sensed by a user as a slight tingling sensation. It is to be noted that such vibrations would be substantially nonexistent if the perforations 28 were eliminated, since the flexible material of mattress 11 in a closed system would tend to dampen the pulsations produced by the pulsatile pump, the chambers of the pad in effect acting as dampening chambers.

While in the foregoing an embodiment of the invention has been disclosed in considerable detail for purposes of illustration, it will be understood by those skilled in the art that many of these details may be varied without departing from the spirit and scope of the invention.

I claim:

1. A pad assembly for supporting a bedridden patient to reduce the development of decubitus uclers, said assembly including a pad having two sets of interlaced inflatable-deflatable air chambers and having a multiplicity of perforations in its top surface to permit the escape of air from said chambers for deflation thereof, a porous air-permeable liquid-absorbent cover sheet upon said pad, and inflating means for cyclically and alternately inflating each of said air chambers while the other of said chambers is deflating because of the escape of air through the perforations thereof, wherein the improvement comprises:

pulsing means provided by said inflating means for pulsing the air flowing essentially unidirectionally to said pad at a frequency within the range of about 15 to 65 pulses per second to produce a rapidly pulsing discharge of puffs of air from said perforations and into said cover sheet for promoting the evaporation of moisture absorbed by said sheet.

2. The assembly of claim 1 in which said frequency falls within the range of about 25 to 35 pulses per second.

3. The assembly of claim 2 in which said frequency is about 29 to 30 pulses per second.

4. A system for supporting bedridden patients to reduce the development of decubitus ulcers, said system including a pad having a pair of interlaced inflatable-deflatable air chambers and having a multiplicity of perforations through its top surface for permitting the escape of deflating air from said chambers, a resilient liquid-absorbent cover sheet of open-celled plastic foam upon said pad, and inflating means for cyclically and alternately inflating each of said chambers while the other of said chambers is deflating because of the escape of air through the perforations thereof, said inflating means including a pulsatile air pump for pulsing the air flowing essentially unidirectionally to said pad at a frequency within the range of 15 to 65 pulses per second, whereby, chamber-deflating air is discharged as puffs of air from said perforations and into said foam sheet for promoting the evaporation of perspiration absorbed by said foam sheet.

5. The assembly of claim 4 in which a solenoid-operated selector valve assembly is interposed along said passage means between said pump and said pad for directing air alternately to one chamber and then the other chamber of said pad.

6. The assembly of claim 5 in which electrical timing means is provided for controlling the operation of said selector valve assembly so that the inflation of each chamber of said pad commences slightly before the flow of air to the other chamber is discontinued.

7. The assembly of claim 6 in which said inflation of each chamber commences about 0.3 to 3.0 seconds before the flow of air to the other of said chambers is discontinued.

8. The assembly of claims 1 or 6 in which said sheet is formed of open-celled resilient plastic foam.

9. A pad assembly for supporting a bedridden patient to reduce the development of decubitus ulcers, said assembly including a pad having two sets of interlaced inflatable-deflatable air chambers and having a multiplicity of perforations in its top surface to permit the escape of air from said chambers for deflation thereof, a porous air-permeable liquid-absorbent cover sheet upon said pad, and inflating means for cyclically and alternately inflating each of said air chambers while the other of said chambers is deflating because of the escape of air through the perforations thereof, wherein the improvement comprises:

pulsing means provided by said inflating means and comprising a pulsatile air pump for pulsing the air flowing essentially unidirectionally to said pad at a frequency within the range of about 15 to 65 pulses per second to produce a rapidly pulsing discharge of puffs of air from said perforations and into said cover sheet for promoting the evaporation of moisture absorbed by said sheet, passage means extending from said pump to said pad for transmitting pulsating air to said chambers, said passage means comprising a first passage and a bypass passage, said bypass passage including a flow restrictor for dampening out said pulses, and valve means for selectively opening and closing said bypass passage to cause air flowing through said passage means to pulsate or be depulsed.

10. The system of claim 4 in which said frequency falls within the range of 25 to 35 pulses per second.

11. The system of claim 10 in which said frequency falls within the range of about 29 to 30 pulses per second.

12. A system for supporting bedridden patients to reduce the development of decubitus ulcers, said system including a pad having a pair of interlaced inflatable-deflatable air chambers and having a multiplicity of perforations through its top surface for permitting the escape of deflating air from said chambers, a resilient liquid-absorbent cover sheet of open-celled plastic foam upon said pad, and inflating means for cyclically and alternately inflating each of said chambers while the other of said chambers is deflating because of the escape of air through the perforations thereof, said inflating means including a pulsatile air pump for pulsing the air flowing essentially unidirectionally to said pad at a frequency within the range of 15 to 65 pulses per second, whereby, chamber-deflating air is discharged as puffs of air from said perforations and into said foam sheet for promoting the evaporation of perspiration absorbed by said foam sheet, and passage means extending from said pump to said pad for transmitting pulsing air to said chambers, a solenoid-operated selector valve assembly interposed along said passage means between said pump and said pad for directing air alternately to one chamber and then the other, said passage means being bifurcated between said pump and said selector valve assembly to provide a first passage and a bypass passage, said bypass passage including pulse dampening means for dampening said pulses, and valve means in said bypass passage for selectively opening and closing said bypass passage to cause air flowing through said passage means to pulsate or be depulsed.

13. The system of claim 12 in which said pulse dampening means comprises a flow restrictor in said bypass passsage.

14. The system of claim 12 in which timing means is provided for controlling said solenoid-operated selector valve assembly so that the inflation of each chamber of said pad commences slightly before the flow of air to the other of said chambers is interrupted.

15. The system of claim 14 in which said timing means controls said solenoid valve assembly to provide inflation and deflation cycles of no more than 30 seconds each and in which the inflation cycle of each chamber commences about 0.3 to 3.0 seconds before the flow of air to the other of said chambers is discontinued.

16. The assembly of claim 12 in which said valve means is located in said bypass passage and when open allows air to flow through both said first passage and said bypass passage.

17. A method for promoting the absorption and evaporation of perspiration from a bedridden patient, comprising the steps of supporting a patient upon a pad having two sets of interlaced and alternately inflatable and deflatable air chambers, said pad having perforations in its upper surface for the discharge of air from said chambers and being covered by a porous air-permeable liquid-absorbing cover sheet interposed between said upper surface and said patient, alternately inflating each of said air chambers while the other of said chambers is deflating because of the escape of air through the perforations thereof, and pulsing the air flowing essentially unidirectionally to said pad at a frequency within the range of about 15 to 65 pulses per second to produce a rapidly-pulsing discharge of puffs of air from said perforations and into said porous cover sheet for promoting the evaporation of perspiration absorbed by said sheet.

18. The method of claim 17 in which said pulses are at a frequency within the range of about 25 to 35 pulses per second.

19. The method of claim 19 in which said pulses are at a frequency within the range of about 29 to 30 pulses per second.

20. The method of claim 17 in which the inflating of each of said chambers commences and ends abruptly, the inflation of each chamber commencing slightly before the flow of air to the other of said chambers is discontinued.

21. The method of claim 20 in which the inflation of each chamber commences approximately 0.3 to 3.0 seconds before the flow of air to the other of said chambers is discontinued.

22. The method of claim 17 in which said cover sheet is formed of open-celled plastic foam.

23. The method of claim 17 in which the minimum air pressure within said chambers is no lower than about 1.0 psi while said method is being performed.

* * * * *